US009245396B2

(12) United States Patent
Delong et al.

(10) Patent No.: US 9,245,396 B2
(45) Date of Patent: Jan. 26, 2016

(54) METHOD AND SYSTEM FOR PROVIDING INTELLIGENT ALERTS

(71) Applicant: HTI IP, LLC, Atlanta, GA (US)

(72) Inventors: Jeffrey Delong, Atlanta, GA (US); Marc Gordan, Atlanta, GA (US)

(73) Assignee: HTI IP, LLC, Atlanta, GA (US)

( * ) Notice: Subject to any disclaimer, the term of this patent is extended or adjusted under 35 U.S.C. 154(b) by 37 days.

(21) Appl. No.: 14/215,183

(22) Filed: Mar. 17, 2014

(65) Prior Publication Data

US 2015/0262435 A1 Sep. 17, 2015

(51) Int. Cl.
*G08B 1/08* (2006.01)
*G07C 5/08* (2006.01)

(52) U.S. Cl.
CPC ..... *G07C 5/0816* (2013.01); *G07C 5/085* (2013.01)

(58) Field of Classification Search
CPC . H04W 4/02–4/04; H04W 4/06; H04W 4/12; H04W 4/14; G08G 1/0962–1/0968; G01C 21/362; G01C 21/3679; G01C 21/3685; G01C 21/3476; H04L 67/04; H04L 67/18; H04L 67/22; G07C 5/0816; G07C 5/085
USPC ..... 340/539.13, 691.6, 692; 455/414.1, 455/456.1, 456.3, 457, 404.2
See application file for complete search history.

(56) References Cited

U.S. PATENT DOCUMENTS

| | | | | |
|---|---|---|---|---|
| 2010/0041378 | A1* | 2/2010 | Aceves et al. | 455/414.1 |
| 2011/0307188 | A1* | 12/2011 | Peng et al. | 702/33 |
| 2013/0090133 | A1* | 4/2013 | D' Jesus Bencci et al. | 455/456.2 |
| 2013/0210461 | A1* | 8/2013 | Moldavsky et al. | 455/456.3 |
| 2013/0267255 | A1* | 10/2013 | Liu et al. | 455/456.3 |

* cited by examiner

*Primary Examiner* — Thomas Mullen

(57) ABSTRACT

A system and method for providing intelligent alerts using data from sensors, mapping data, POI/events data, environmental data, and/or user data. The sensors may include a telematics control unit (TCU) on a vehicle, and the intelligent alerts may be based on a deviation in a pattern (of a user or of vehicles generally) or a new location traveled to by the user. Intelligent alerts may prompt a user to post a message on a social media network, to leave a review, or may simply provide information to the user. Intelligent alerts may be sent to users away from the vehicle, to users in the vehicle, or to the vehicle itself, such as on a vehicle display.

20 Claims, 5 Drawing Sheets

METHOD AND SYSTEM FOR PROVIDING INTELLIGENT ALERTS

FIELD OF THE INVENTION

The field of the present invention relates generally to a method and system for providing intelligent alerts using sensor information and historical data.

BACKGROUND

Many modern vehicles have a telematics control unit or an on-board diagnostics device installed. These devices gather data and occasionally transmit messages to drivers of the vehicle. However, such messages are generally one-to-one in that the message is only based on one vehicle and is sent to only one person. Additionally, an individual may receive a message in the form of an alert based on their current location, but such alerts often lack intelligence in that they are not based on driving or locational patterns or historical location and time data.

BRIEF DESCRIPTION OF THE DRAWINGS

In order to facilitate a fuller understanding of the exemplary embodiments, reference is now made to the appended drawings, in which like reference characters are used to indicate like elements. These drawings should not be construed as limiting, but are intended to be exemplary only.

DETAILED DESCRIPTION OF EMBODIMENTS

Figure 1:
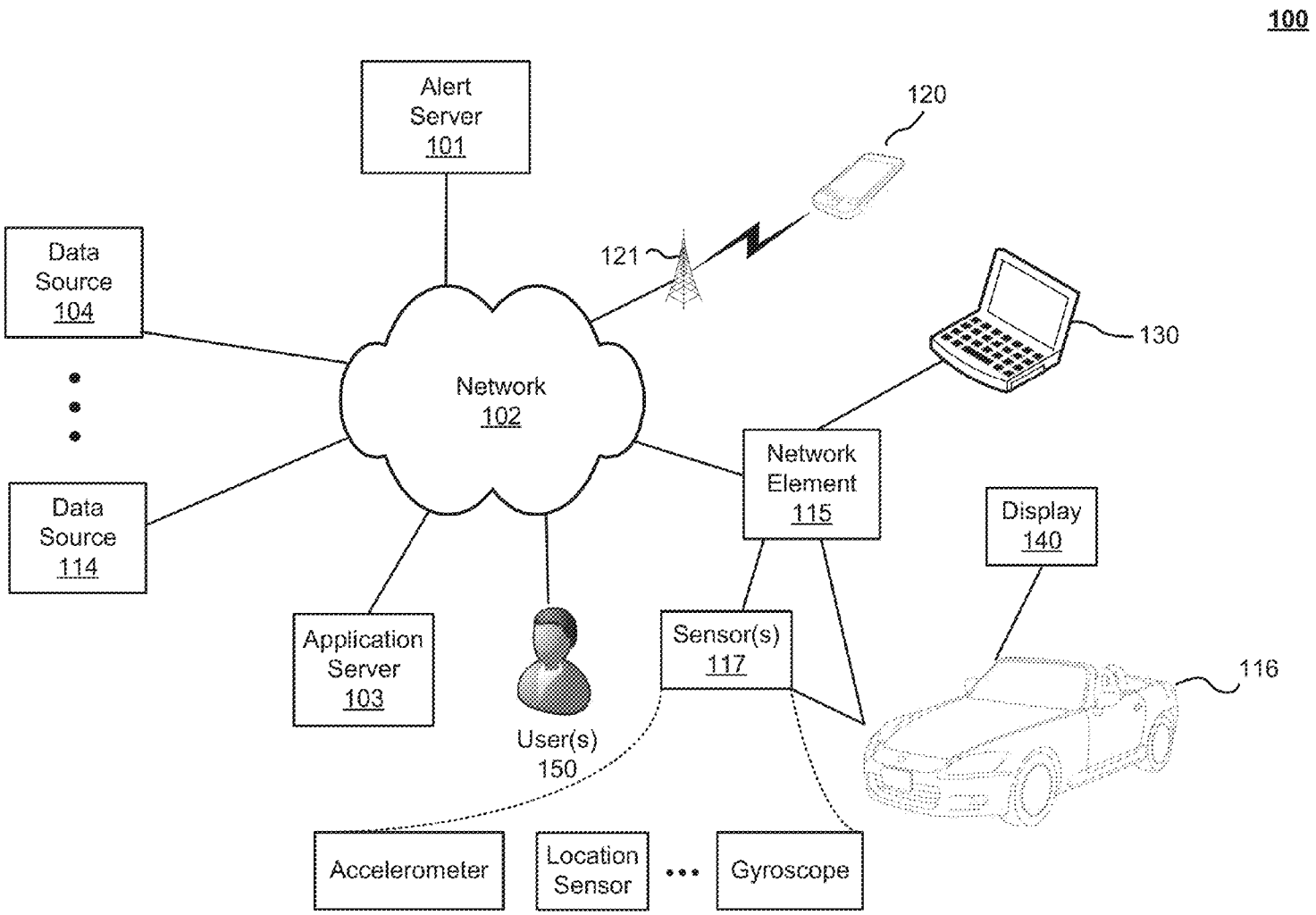
FIG. 1 depicts a block diagram of a system architecture for gathering data and sending intelligent alerts through a network, according to an exemplary embodiment.

A system is needed that provides intelligent alerts based on current, anticipated, and/or historical location and time data, and which also may be based on vehicle sensor data. Such alerts may include intelligent alerts that are not only one-to-one, but one-to-many, many-to-one, or many-to-many. Reference will now be made in detail to exemplary embodiments, examples of which are illustrated in the accompanying drawings. It should be appreciated that the same reference numbers will be used throughout the drawings to refer to the same or like parts. The following description is intended to convey a thorough understanding of the embodiments described by providing a number of specific embodiments. It should be appreciated that the following detailed descriptions are exemplary and explanatory only and are not restrictive. As used herein, any term in the singular may be interpreted to be in the plural, and alternatively, any term in the plural may be interpreted to be in the singular.

The description below describes modules that may include one or more servers, databases, subsystems and other components. As used herein, the term "module" may be understood to refer to non-transitory executable software, firmware, processor or other hardware, and/or various combinations thereof. Modules, however, are not to be interpreted as software that is not implemented on hardware, firmware, or recorded on a tangible processor-readable or recordable storage medium (i.e., modules are not software per se). The modules are exemplary and may be combined, integrated, separated, and/or duplicated to support various applications and may be centralized or distributed. A function described herein as being performed at a particular module may be performed at one or more other modules and/or by one or more other devices instead of or in addition to the function performed at the particular module. The modules may be implemented across multiple devices and/or other components local or remote to one another. The devices and components that comprise one module may or may not be distinct from the devices and components that comprise other modules.

Embodiments of the system provide the ability to gather data from a user, a device associated with user(s), vehicle(s), databases, and/or third party sources, for the exemplary purpose of providing an intelligent alert to one or more users. As used herein, the term "alert" may be interpreted as a notification, a prompt, or a request. Alerts may be one-to-one, one-to-many, many-to-one, or many-to-many. One exemplary embodiment relates to a driver of a vehicle and gathering data from a telematics control unit ("TCU device") on the vehicle, from the user him/herself, from a device of the user (such as a mobile device), from various databases, and/or from various third parties to provide an intelligent alert to the driver or another user. In exemplary embodiments, drive data, location data, and/or time data may be used to determine a normal or expected pattern of behavior (such as driving behavior and/or "locational behavior") of a user. This normal or typical pattern of behavior may be compared to new drive data, location data, and/or time data to determine whether this new data is typical or atypical for the particular user. A quantitative and qualitative analysis of old and new data can provide better relevance and timing of alerts to one or more users. Such analysis may yield a determination of whether the new data is abnormal, unique, or atypical (or normal, standard, or typical) compared to the user's historical behavior or other historical data (such as data from other users or vehicles). The alert may relate to an event or news that the user receiving the alert would like to share or needs to hear.

In a more specific exemplary embodiment, the user may be a driver of a vehicle having a TCU device. The driver may travel from location "A" to location "B" in the morning every weekday, and from location "B" to location "A" in the evening of every weekday. Locations "A" and "B" may be compared to map data stored in a mapping database, which may reveal that location "A" is a single family residence and location "B" is a parking lot adjacent to a particular business. Based on this data, a determination may be made that the user lives at location "A" and works at location "B." Additionally, the historical routes taken by the driver from locations "A" to "B" and "B" to "A" may be recorded and categorized as the driver's typical route or driving pattern from home to work and from work to home. This typical route data may also be compared to map data and a point-of-interest (POI) database. For example, it may be determined that the user drives by a stadium on his way home from work. An intelligent alert may be provided to the user indicating that an event is taking place in the stadium. The alert may be sent before (e.g., days before) the event begins, and may be based on a comparison of the event's start time to the typical time that the user drives past the stadium on his way home from work.

A different type of intelligent alert may be sent based on a deviation from the user's typical behavior (in this case, the commute between locations "A" and "B"). For example, new data may be received indicating that the user stopped at the stadium on his way home from work. The new data may be categorized as a deviation from the user's typical behavior. Based on this deviation, an alert may be sent to the user (driver) or another user (e.g., family member at home). The alert may, for example, prompt the user with an option to post on social media that he is attending a particular event at the stadium. For example, an option may be provided in the intelligent alert to post a predetermined or custom message on one or more social media sites, such as the predetermined message: "Attending tonight's Washington Nationals game!" Alternatively, the alert may prompt the user to send a message to another user, such as the family member at home, with either a predetermined message or a custom message based on the deviation from typical behavior and/or the current time and location. For example, the alert may prompt the user with the following predetermined message: "Do you want to text [family member] the following: 'I decided to attend the game tonight.'?" The new data (e.g., time and location data of the user) may be compared to a data source, such as a calendar of events, which may yield a determination as to which particular event is taking place at the location (e.g., Washington Nationals game at the stadium). Such information may be included in a predetermined text or a predetermined social media post, for example. The "calendar of events" may be the calendar of events for the particular point-of-interest or the user's own personal calendar. In the case where the new data is compared to the user's own personal calendar, the user may have scheduled the event at the stadium in his calendar. In such a case, the new data may be determined to be a deviation from the user's typical behavior, but not from the expected behavior based on the user's calendar. An alert may still be sent to the user prompting the user with an option to post on social media that he is attending the scheduled event. Alternatively, the alert may prompt the user to text the family member at home with a different predetermined message, based on the event being scheduled in the user's personal calendar, such as, "Made it safe to the game!" In some circumstances, intelligent alerts may automatically be sent to one or more users without prompting a user.

Another type of intelligent alert may be sent to the user based not only on a deviation from the user's typical behavior, but on vehicle information subsequent to a determination of the deviation from the user's typical behavior. For example, using data from the vehicle's TCU device (e.g., accelerometer data or GPS data), it may be determined that the user has, in fact, entered the parking lot of the stadium, or pulled into a parking space in a designated stadium parking lot. Vehicle information can be used to more precisely time transmission of the alert, and may even influence which type of alert is sent. For example, if it has been determined that the user has pulled into the parking lot of the stadium, the alert may be triggered at, or several seconds after, the vehicle's engine has been shut down, rather than when the user is still driving around the parking lot (which may be too early) or after the user has entered the stadium (which may be too late for some types of alerts). In this manner, the alert may be more precisely timed, and the user may be more likely to notice such alerts.

More precise, and hence more intelligent, alerts may also be sent after the event has occurred, and may be based on vehicle information, other sensor information, event information, and/or calendar information, for example. It may be determined that the event has finished based on the vehicle starting up again, the user leaving the parking lot, or as indicated by an end time of the event in the event information or calendar information. For example, a user may start his vehicle and leave the parking lot of an event. At that point or soon thereafter, the user may be sent an intelligent alert prompting the user to provide a review of the event or of the location that the user just left. For example, the location may be a restaurant and the "event" may simply be dinner at the restaurant. Once the user leaves the parking lot, or upon arrival at home (location "A"), for example, an alert may be sent to the user prompting him/her to provide a review of the restaurant on a particular website or application, such as a social media website, a review website, the restaurant's website, or an application on a user device. As can be seen, various data may be used to provide the user (or a related user) with intelligent alerts to provide information to the user or request information from the user. Additional exemplary embodiments are disclosed below with reference to the figures.

Referring to FIG. 1, a schematic diagram of a system 100 for gathering data from various sources or devices is shown, according to an exemplary embodiment. As illustrated, network 102 may be communicatively coupled with one or more alert displaying devices, one or more data transmitting devices or entities, network element 115, or wireless transceiver 121. Exemplary alert displaying devices may include a mobile device 120, vehicle display 140, network client 130, or network element 115, for example. These and other types of alert displaying devices may be communicatively coupled directly with network 102 or via one or more intermediary devices, such as transceiver 121 or network element 115.

It should be appreciated that the system 100 of FIG. 1 may be implemented in a variety of ways. Architecture within system 100 may be implemented as a hardware component (e.g., as a module) within a network element or network box. It should also be appreciated that architecture within system 100 may be implemented in computer executable software (e.g., on a tangible computer-readable medium). Module functionality of architecture within system 100 and even the alert server 101 of FIG. 1 may be located on a single device or distributed across a plurality of devices including one or more centralized servers and one or more mobile units or end user devices.

Network 102 may be a wireless network, a wired network or any combination of wireless network and wired network. For example, network 102 may include one or more of a fiber optics network, a passive optical network, a cable network, an Internet network, a satellite network (e.g., operating in Band C, Band Ku or Band Ka), a wireless LAN, a Global System for Mobile Communication ("GSM"), a Personal Communication Service ("PCS"), a Personal Area Network ("PAN"), D-AMPS, Wi-Fi, Fixed Wireless Data, IEEE 802.11a, 802.11b, 802.15.1, 802.11g, 802.11n, 802.11ac, or any other wired or wireless network for transmitting or receiving a data signal. In addition, network 102 may include, without limitation, telephone line, fiber optics, IEEE Ethernet 802.3, a wide area network ("WAN"), a local area network ("LAN"), or a global network such as the Internet. Also, network 102 may support, an Internet network, a wireless communication network, a cellular network, Bluetooth, or the like, or any combination thereof. Network 102 may further include one, or any number of the exemplary types of networks mentioned above operating as a stand-alone network or in cooperation with each other. Network 102 may utilize one or more protocols of one or more network elements to which it is communicatively coupled. Network 102 may translate to or from other protocols to one or more protocols of network devices.

Although network 102 is depicted as one network, it should be appreciated that according to one or more embodiments, network 102 may comprise a plurality of interconnected networks, such as, for example, a service provider network, the Internet, a broadcaster's network, a cellular network, corporate networks, municipal networks, government networks, or home networks.

Network client 130 may be a desktop computer, a laptop computer, a tablet, a server, a personal digital assistant, a television, a set-top-box, a digital video recorder (DVR), or other computer capable of sending or receiving network signals. Network client 130 may use a wired or wireless connection. It should also be appreciated that the network client 130 may be a portable electronic device capable of being transported.

Transceiver 121 may be a repeater, a microwave antenna, a cellular tower, or another network access device capable of providing connectivity between different network mediums. Transceiver 121 may be capable of sending or receiving signals via a mobile network, a paging network, a cellular network, a satellite network or a radio network. Transceiver 121 may provide connectivity to one or more wired networks and may be capable of receiving signals on one medium such as a wired network and transmitting the received signals on a second medium, such as a wireless network.

Mobile device 120 may be a mobile communications device, a smartphone, a tablet computer, a wearable computer such as in the form of a wrist watch, bracelet, or glasses, a home phone, a cellular phone, a mobile phone, a satellite phone, a personal digital assistant, a computer, a handheld multimedia device, a personal media player, a gaming device, a mobile television, or other devices capable of displaying alerts and communicating directly with network 102 or via transceiver 121. Mobile device 120, network client 130, and vehicle display 140 may connect to network 102 and communicate with other network elements, servers or providers using WiFi, 3G, 4G, Bluetooth, or other chipsets.

Network element 115 may include one or more processors (not shown) for recording, transmitting, receiving, or storing data. Network element 115 may transmit and receive data to and from network 102. The data may be transmitted and received utilizing a standard telecommunications protocol or a standard networking protocol. For example, one embodiment may utilize text messages and/or a Short Message Service "SMS." In other embodiments, the data may be transmitted or received utilizing Session Initiation Protocol ("SIP"), Voice Over IP ("VoIP"), or other messaging protocols. Data may also be transmitted or received using Wireless Application Protocol ("WAP"), Multimedia Messaging Service ("MMS"), Enhanced Messaging Service ("EMS"), Global System for Mobile Communications ("GSM") based systems, Code Division Multiple Access ("CDMA") based systems, Transmission Control Protocol/Internet Protocols ("TCP/IP"), hypertext transfer protocol ("HTTP"), hypertext transfer protocol secure ("HTTPS"), real time streaming protocol ("RTSP"), or other protocols and systems suitable for transmitting and receiving data. Data may be transmitted and received wirelessly or in some cases may utilize cabled network or telecom connections such as an Ethernet RJ45/Category 5 Ethernet connection, a fiber connection, a cable connection or other wired network connection. A number of different types of signals or alerts may be transmitted via network 102 including, but not limited to, alerts indicative of information content, such as a text message, a voice message (including computer generated voice messages), an email, an alert, a prompt, a notification, a banner, a pop-up, a video signal, a link, a vibration pattern, a visual light signal, a ring tone, or any combination of the foregoing.

Figure 3:
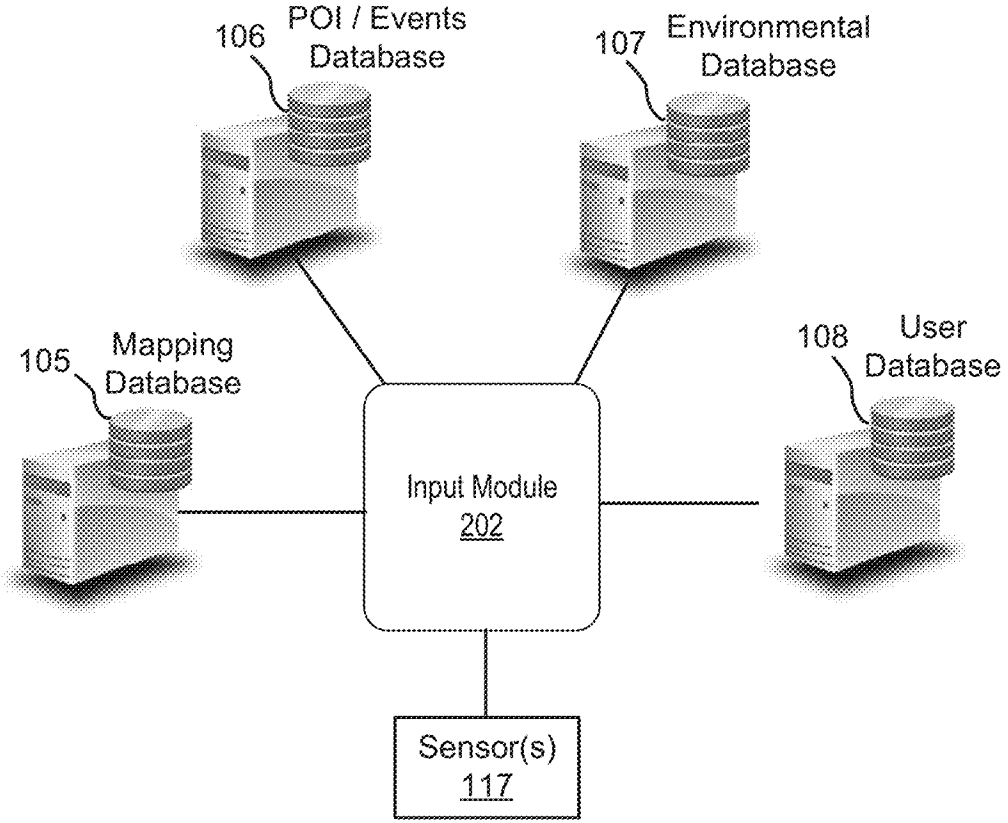
FIG. 3 depicts exemplary sources of data to aid in generating and sending intelligent alerts, according to an exemplary embodiment of the invention.

Data sources 104 . . . 114 represent various entities or databases that provide relevant data, such as maps data, location data, geographic data, point-of-interest (POI) data, building data, campus data, calendar data, events data, website data, social media data, application data, environmental data, user data, contact information, stored processing device data, weather data, news alert data, traffic data, accident data, hazard data, or other forms of data. For simplicity, as shown in FIG. 3, the various sources of data may be considered to fall under mapping database 105, POI/Events database 106, environmental database 107, user data 108, and database from sensors 117 (such as a TCU device or mobile device 120, for example).

Application server 103 may provide an application to a computing device such as mobile device 120, vehicle display 140, or network client 130, for example. Via an application installed on the computing device, the user may establish various user settings, including privacy and tracking settings. The application may be, or may be linked to, a third-party application, such as a maps application. Also, the application may be a social media add-on such that it operates in conjunction with a social media application, but may nevertheless be maintained by an entity other than the social media entity.

User settings may be established by the user within the application, or using an associated website on the Internet, and may be stored on the computing device (e.g., mobile device 120 or vehicle display 140), on application server 103, in user database 108, or in storage module 234. The user settings and may be retrieved by input module 202 and used by decision module 232 when generating and sending intelligent alerts.

User(s) 150 may be a user of a computing device, a person or computing device that receives an intelligent alert, or a driver of vehicle 116, for example. User(s) 150 may be singular or plural.

Vehicle display 140 may include a display in vehicle 116, such as a touchscreen device or a dashboard display, including a plasma display panel (PDP), liquid crystal display (LCD), thin film transistor (TFTLCD), super LCD, light emitting diode (LED), organic LED (OLED), active matrix OLED (AMOLED), LED-backlit LCD, super AMOLED, a retina display, or a heads-up-display (HUD).

Sensors 117 in FIG. 1 may include one or more sensors on a user's vehicle, such as the TCU device, or sensors within a user's mobile device. In a first exemplary embodiment, a TCU device on the vehicle 116 may provide substantially all of the data relating to the vehicle and its location, motion, or acceleration. The TCU device may collect large amounts of data regarding the vehicle 116 to which it is attached, including: location (GPS, GLONASS), engine status, speed, stops, starts, temperature, acceleration values, nearby Wi-Fi signals, gyroscope sensor information, height information from an altimeter, visual information from a camera communicatively coupled to the TCU device, audio from a microphone, or revolutions per minute (RPM) of the vehicle's engine, for example. Data may be gathered from multiple TCU devices on multiple vehicles, and it should be appreciated that "TCU device" may refer to "one or more TCU devices." Such data may be gathered anonymously. The TCU device may include a number of sensors including an accelerometer, barometer, altimeter, and gyroscope, for example. Sensors within a user's mobile device may similarly include an accelerometer, gyroscope, or GPS sensor, for example.

Exemplary data that may be captured by the TCU device over a period of time includes location (e.g., latitude and longitude), heading (e.g., degrees), weather conditions (e.g., degrees, precipitation), whether the window wipers are on/off, vehicle speed, vehicle status, whether the headlights are on/off, application of brakes, wheel slippage, skidding, sliding, rate of acceleration (measured in g's in the x, y, z directions, for example), pressure values (e.g., kPa), altitude, grade (rate of incline/decline), forces at wheels, damping forces, fuel consumption, etc. Data may also be interpreted by the categorization module 224 to categorize and/or weight data, including vehicular events such as a hard or soft stop. Data may be weighted by giving the data, or events within the data, a score of 1 to 10. Such weightings may be attached to categorizations of data, and used by decision module 232 to aid in generating and sending intelligent alerts. Additional data may be calculated using data collected by the TCU device and/or data from other databases, such as estimated time of arrival (ETA) to a particular location, rate of ascent or descent using barometric data, force of turns, pivots, or other g-forces, for example. All or a subset of this data may be used by the alert server 101 to generate and send intelligent alerts.

Location data may be collected every 1-2 seconds, for example, by a GPS module within the TCU device or mobile device 120. Acceleration data may be collected by an accelerometer at 50 Hz, for example, and pressure data may be collected by a barometer at 10 Hz, for example. All of the collected data may have a timestamp and location-stamp associated with it to indicate when and where the data was collected, and this timestamp and location-stamp may be tagged to the data itself, and eventually stored with the data in the storage module 234 or user database 108. Data may be collected continuously over a period of time until the vehicle is turned off or until the user directly or indirectly deactivates the TCU device, or more generally, sensors 117.

FIG. 3 shows exemplary sources of data that may be used by embodiments of the present invention (and which may generally correspond to data sources 104 . . . 114 in FIG. 1).

Mapping database 105 may include maps data, location data, geographic data, building data, campus data, traffic data, or GPS data, for example. Sources of this data may be a third party that provides such data for free or for a fee, and may include Google Maps®, OpenStreetMap, NavTeq®, Garmin®, Apple®, Microsoft®, Yahoo®, or TrafficMetrix, for example.

POI/Events database 106 may include point-of-interest (POI) data, calendar data, events data, website data, operating hours data, contact data, social media data, applications data, news alerts, or accident alerts, for example. Website data may include data pulled from social media websites, or websites of businesses, counties, towns, or municipalities, or websites associated with structures or locations such as stadiums, concert halls, parks, coliseums, amphitheaters, resorts, amusement parks, beaches, lakes, national parks, or landmarks, for example. POI data may be compiled in a database managed by one or more businesses. POI data may be proprietary or may be retrieved from third party sources such as POIplaza.com, or may be associated with various map data sources.

Environmental database 107 may include weather data or barometric pressure data, for example. Sources of environmental data may include The National Climatic Data Center or OpenWeatherMap, for example. Environmental data may be taken into account by the system when determining whether, when, or what type of alert to send to the user. For example, driving or locational behavior that may otherwise appear to be atypical may be the result of bad weather. Additionally, alerts may be sent based on the forecasted weather and the user's anticipated location (e.g., driving into a storm in 2.5 hours based on anticipated location, which may in turn be based on GPS directions requested by a user/driver). Alerts may also be timed so as to not distract the user/driver (e.g., while driving in bad weather).

User database 108 may include data gathered over time about a user, data provided by or about a user, user preferences, contact information, user relationships, user accounts, user login information, and/or a quantitative and qualitative assessment of such data. In some exemplary embodiments, the user may be a driver of a vehicle, a person using a mobile device, a person performing the method or system disclosed herein, or a person receiving an intelligent alert. There may be more than one user, just as there may be multiple sensors providing sensor data (e.g., multiple vehicle TCU devices or multiple mobile devices). For example, user data or data from sensors may come from multiple users or multiple users' vehicles or mobile devices. In the case of multiple user vehicles and/or multiple user mobile devices, the system may gather data from multiple TCU devices on multiple vehicles and/or multiple mobile devices, make a quantitative and/or qualitative assessment of such data, and use such data to determine whether, when, and/or what type of alert to send to one or more users. Sources of user data may include the user personally or a device associated with the user.

Data from the TCU device or other sensors (such as sensors within mobile device 120) may be input into user database 108 and/or relayed to input module 202 by the device itself, or the data may be retrieved by a processor in the input module 202. Other data from mapping database 105, POI/Events database 106, environmental database 107, and/or user database 108 may be retrieved by input module 202 as needed.

Some types of data, such as weather data from environmental database 107, may be gathered less frequently than sensor data because such data does not change as frequently as sensor data from the TCU device. Accordingly, such data (e.g., weather data) may be gathered every several minutes, such as every 10-15 minutes, for example. After input module 202 receives (or retrieves) data, the data may be stored in storage module 234.

Figure 2:
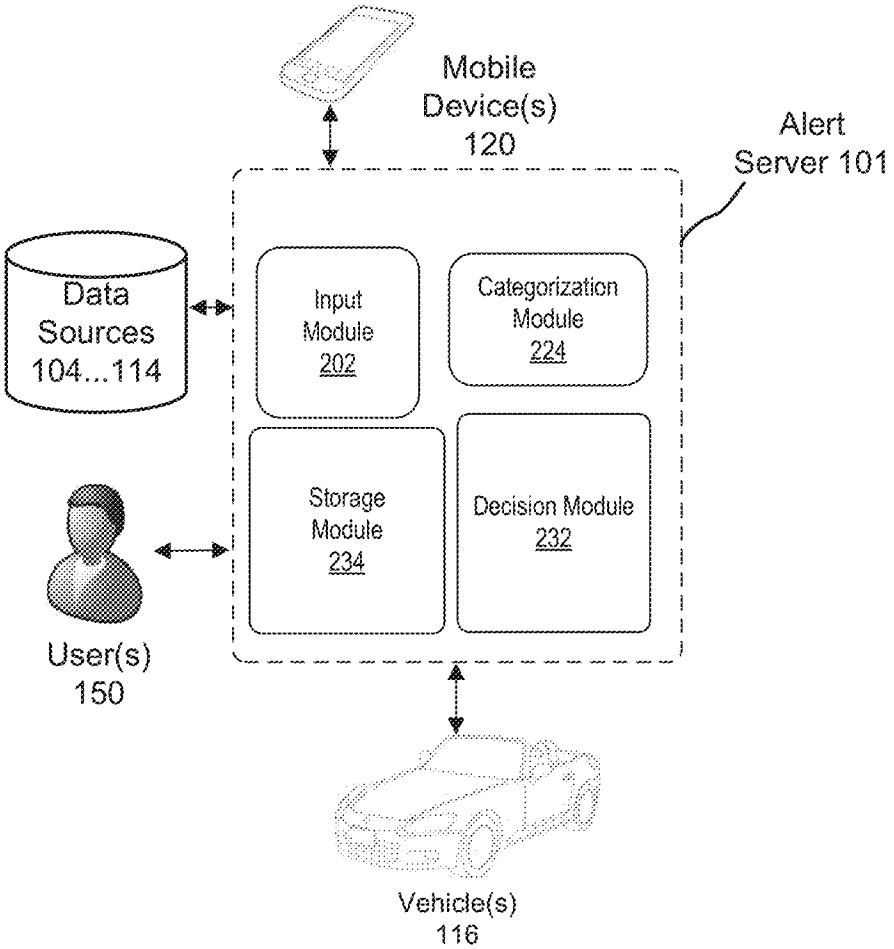
FIG. 2 depicts a block diagram of a hardware module for gathering data, categorizing data, generating intelligent alerts, and sending intelligent alerts, according to an exemplary embodiment of the invention.

FIG. 2 shows a block diagram of hardware modules at an alert server 101, for gathering data, categorizing and/or weighting data, generating intelligent alerts, and outputting such intelligent alerts to one or more users or devices, according to an exemplary embodiment of the invention. Data may be gathered by or received at input module 202 and stored in storage module 234. Data may be retrieved from mobile device 120, sensors 117 such as a TCU device on vehicle 116, user(s) 150, or data sources 104 . . . 114, for example. Categorization module 224 may quantitatively and qualitatively analyze the data, categorize the data, and/or weight the data. Decision module 232 may process the data to generate an intelligent alert, as explained below. Decision module 232 may also output the intelligent alert to one or more users or devices. Decision module 232 may be configured to read data from storage module 234 and/or receive data directly from other modules, to thereby output intelligent alerts. Decision module 232 may communicate directly, or via a network, with the other modules of FIG. 2 or with other system architecture components shown in FIG. 1. To carry out their functions, the modules may have executable instructions stored in a program memory, either within the module itself or in storage module 234. One or more processors coupled to or within the modules are configured to carry out the executable instructions to allow the module to carry out its functions. Using executable instructions and a processor, alert server 101 is able to generate intelligent alerts by gathering, for example, data from mapping database 105, POI/Events database 106, environmental database 107, user database 108, data from sensor(s) 117 (e.g., TCU device), data from mobile device 120, network client 130, network element 115, and/or user(s) 150. Data from user(s) 150 may include data input by the user, user settings, or a calendar associated with the user, for example. Data from the various sources may have timestamps and location-stamps associated therewith to aid in generating intelligent alerts.

As explained further below, decision module 232 may generate intelligent alerts, and output the intelligent alerts to one or more users 150. Alerts sent to a user 150 may generally include alerts sent to a mobile device 120, network client 130, or vehicle display 140, for example. The mobile device 120, network client 130, or vehicle display 140 may run an application configured for displaying intelligent alerts. Intelligent alerts may be sent as text messages, SMS messages, emails, voice messages (including computer-generated voice messages/alerts), video messages, banner messages, social media messages, visual alerts, or any other type of notification to a user of an electronic device. For explanatory purposes, reference will be made to a mobile device 120, such as a smartphone or tablet computer, or a vehicle display 140 receiving intelligent alerts.

Input module 202 may receive data over time from user 150, vehicle 116 (including sensors 117), mobile device 120, or other data sources. In an exemplary embodiment, the data may include drive data, location data, time data, and/or response data. Drive data may comprise sensor data from a TCU device on vehicle 116, examples of which are enumerated above. Location data may comprise the location of a vehicle (or TCU device) or the location of a user's mobile device 120. Time data may be associated with both the drive data and the location data such that the system knows when the particular data was recorded. Response data may comprise information retrieved from user 150 in response to an intelligent alert previously sent to user 150. Data received via input module 202 may be relayed to other modules of alert server 101.

The decision module 232 may determine whether to send intelligent alerts, what intelligent alerts to send and the information to include, when to send, how to send (e.g., text, SMS message, audible message, email, pop-up, or a combination, for example), how to display, how long to display, and/or which individuals or devices should receive the intelligent alerts based on proximity, user settings, or user relationships. The decision module 232 may take into account variables such as user settings, historical data, categorizations, weightings, context of the intelligent alert, location, locational behavior/patterns, driving data from the user or other vehicles, driving behavior/patterns, proximity, the time of day, day of the week, month, or year, and/or the current or forecasted weather, for example. Decision module 232 may send an intelligent alert to one user device and then the same alert to another device of the same user or a different user. Additionally or alternatively, a user device, such as mobile device 120, may be configured to transmit an intelligent alert received at the user device to another user device. For example, mobile device 120 may be configured to send an alert over short range wireless to the speaker system of vehicle 116; or mobile device 120 may send the received intelligent alert to the TCU device of vehicle 116, which TCU device may then present the alert visually on vehicle display 140 or audibly over speakers of vehicle 116, or both. Also, a user may receive an intelligent alert at one user device, but choose to input a response (e.g., post a message or write a text) via another user device. The user device that received the intelligent alert may provide an option for the user to respond via another user device.

Importantly, the decision module 232 may take into account user profiles and/or user settings (which may be stored in user database 108) before distributing intelligent alerts to a user 150. The user settings may include a "do not track" (or, alternatively, an "opt-in") option that may be enabled by the user via an application on mobile device 120 or vehicle display 140, for example. Such a setting would prevent (or allow) alert server 101 from collecting and/or using data relating to the user (e.g., driving data and/or location data). It should be noted that to the extent the various embodiments herein collect, store or employ personal information provided by individuals, such information shall be used in accordance with all applicable laws concerning protection of personal information. Additionally, the collection, storage and use of such information may be subject to consent of the individual to such activity, for example, through well known "opt-in" or "opt-out" processes as may be appropriate for the situation and type of information. Storage and use of personal information may be in an appropriately secure manner reflective of the type of information, for example, through various encryption and anonymization techniques for particularly sensitive information.

Decision module 232 may generate intelligent alerts and determine whether and/or when to send intelligent alerts. As to generating intelligent alerts, numerous predetermined alerts (or portions of alerts) may be stored within storage module 234. Such predetermined alerts may include standard text based on particular circumstances, and such alerts may be "predetermined" by decision module 232 and/or input/saved by user 150. The particular circumstances may include who the alert is from, who is receiving the alert, whether the alert is based on locational and/or driving behavior, the time of the alert, and more generally, the subject matter of the alert. For example, an alert requesting user 150 to leave a review for a movie that user 150 just watched may state, "Would you like to review the movie you just viewed at [AB Cinema]? Yes/No." Information in brackets is exemplary only, and may represent information retrieved from one or more of the databases in FIG. 2, from user 150, from a device of user 150 (e.g., mobile device 120), and/or from TCU device in vehicle 116, for example. Decision module may include underlined text in the alert to indicate that the text is a hyperlink, which may link user 150 to another application, a website on the Internet, or lead user 150 to an additional option for choosing. Further details on generating and sending intelligent alerts may be understood from the various embodiments disclosed herein.

As to determining whether to send an intelligent alert, decision module 232 may take into account user settings, and may use various categorizations and weightings from categorization module 224. For example, categorization module 224 may categorize particular behavior as atypical, based on a comparison of current driving or location data to historical driving or location data. Atypical behavior may be more likely to prompt an intelligent alert than typical behavior. Accordingly, decision module 232 may determine to send an intelligent alert upon receipt of an atypical categorization of particular behavior by categorization module 224, such as a departure from a typical route traveled, arrival at a new location, an atypical visit to a point of interest, a departure (e.g., non-attendance) from a scheduled event, or a deviation from a determined pattern, for example. Further, categorization module 224 may give greater weight to certain data, such as a first-time visit to a point of interest, or in other embodiments, a large number of visits to a point of interest.

As to determining when to send an intelligent alert, decision module 232 may take into account user settings, the time of day/evening, the user's location, and various historical data, such as when the user arrived or left a point of interest, for example. Decision module 232 may compare the location of user 150 (e.g., vehicle 116 and/or a device of user 150, such as mobile device 120) to known POIs stored in POI/Events database 106 to obtain proximity data. The proximity data may be used by decision module 232 in the determination of whether and/or when to send an intelligent alert to a user. When to send an intelligent alert may be dependent on user settings, whether the user is entering or leaving a POI, the user's current or future/anticipated location, the weight given to the user's location by the categorization module 224 (e.g., the user's anticipated location at a future time may be near a hazard, and the user's safety can be given greatest weight), the type of POI, the time of day/evening, environmental conditions (e.g., a user may be unlikely to notice, or may be distracted, by an alert when it is raining), or whether the user is currently driving, for example. By way of example, if user 150 arrives at a movie theater called AB Cinema and stays at that location for the next 45 minutes, categorization module 224 may determine that user 150 is likely viewing a movie, based on the location of the user/vehicle (as determined from location data received from a TCU device on vehicle 116 or a user's mobile device 120, and information retrieved from mapping database 105) and the duration that user 150 has stayed at that location. Rather than send an alert asking the user to leave a review or post a comment on a social media website while user 150 is viewing the movie, decision module 232 may wait until user 150 leaves AB Cinema, or may wait until user 150 arrives home, before sending an intelligent alert to user 150 asking whether he/she would like to leave a review of the movie they just watched at AB Cinema. Additionally, the intelligent alerts may be timed so as to not distract user 150, or to send at a time when user 150 is most likely to respond to (or interact with) the alert. Decision module 232 may also control the duration that the intelligent alert is displayed or sounded on the user's mobile device 120 or vehicle display 140, for example. Intelligent alerts may be configured to be displayed or sounded until minimized by user 150, or may be configured to be displayed/sounded for a predetermined amount of time (e.g., 3-10 seconds, indefinitely, while user 150 is within "X" feet of "Y" POI, while the subject matter of the alert remains relevant, or simply for the duration of an audible alert). Intelligent alerts may be repeatedly displayed or sounded (e.g., 2 times). Intelligent alerts may also be modified over time. For example, an intelligent alert repeated 60 seconds after an initial intelligent alert may include different data or a different urgency, which may be based on the user's updated location data.

Categorization module 224 may be used to categorize data to aid in determining whether to send an intelligent alert. Categorization module 224 may be used to determine and categorize a normal or expected pattern of behavior (such as driving behavior and/or "locational behavior") of a user (or non-user) and/or atypical behavior of a user (or non-user). In some embodiments, data may be gathered anonymously from a non-user for the benefit of a user of the present invention, as explained in further detail below. However, in one exemplary embodiment, data for a "new" user may be gathered over a period of time, such as three months, to identify a normal pattern of behavior for said "new" user. For example, the location of the user throughout a 24-hour period may be determined based on data received from a TCU device on the user's vehicle 116, or from the user's mobile device 120. This data may be analyzed to determine a pattern of driving and/or locational behavior. For example, the data may comprise both a location component and a time component. The location component may comprise coordinates of a geographic location, including "X" and "Y" components, or latitudinal and longitudinal components. These latitudinal and longitudinal components may be plotted against the corresponding time component of a particular datum of the data on a 2D, 3D, or even a 4D graph. For example, on a 3D graph, the time component may be plotted along the Z-axis, and the latitudinal and longitudinal coordinates may be plotted on the X- and Y-axes, respectively. Each day, or 24-hour period, may be plotted for a particular user to form one line on the graph. Each day of the week (e.g., Mondays or Saturdays) or each day of the year (for example, February 3$^{rd}$ or December 31$^{st}$) may have its own graph for comparative purposes (i.e., to compare Mondays to Mondays, or one December 31$^{st}$ to other December 31$^{sts}$). Over time (for example, three months), as new lines are added, it may become apparent that several data points and also several lines overlap each other, which may be indicative of a pattern. For example, several X and Y data points (corresponding to location) will overlap when the user is in one place, such as at home or at work/school. Based on the time of day and with reference to mapping database 105, it may be determined that location $X_1$, $Y_1$, for example, (or location "A") is likely where the user 150 resides (e.g., a single family home at address 1755 Hope Street) and that location $X_{50}$, $Y_{50}$, for example, (or location "B") is likely where user 150 works (e.g., Triple A LLP at 6053 University Drive). It may also be determined, based on the time of day and with reference to mapping database 105, that data points between locations "A" and "B" correspond to a route that user 150 takes from home to work and from work to home. On a graph of "locational behavior" encompassing several weeks or months, each line representing a 24-hour period may typically only match up on five out of seven lines in a particular week, and it may be determined that the user typically only travels from "A" to "B" on the weekdays. Similar analyses can be performed to determine typical routes traveled, driving patterns, or patterns over more finite periods of time. For example, patterns over periods of several minutes (such as 8:15 AM-8:30 AM on Fridays) versus several hours (9:00 AM-5:30 PM on weekdays) can be determined through comparative analysis. Thus, by comparing behavior (e.g., locational and/or driving behavior) at one time period to other time periods, categorization module 224 may identify normal or typical patterns of behavior, and ultimately abnormal or atypical behavior.

Other "locational behavior" patterns may readily be determined, such as where the user attends school or church, or locations that the user frequents, such as restaurants, gyms, or stores. Such patterns may include times when the user is at particular locations. For example, it may be determined that user 150 frequents Silver's Gym on Tuesday evenings from approximately 7:00-8:30 pm, but only 65% of Tuesday evenings does user 150 travel to this gym. From this pattern, it may be determined that user 150 is a member of Silver's Gym. Relevant intelligent alerts may include a prompt for the user to leave a review of Silver's Gym, either after an initial visit or after several visits. Alternatively, if user 150 does not travel to Silver's Gym on a given Tuesday evening, an intelligent alert may take the form of a motivational alert to motivate user 150 to go to Silver's Gym the next Tuesday or before the next Tuesday arrives.

By way of further example, data for user 150 may reflect that user 150 is away from location "A" at 11:30 pm on any given day only 5% of the time, and within this 5% of the time, user 150 is more than 50 miles away from location "A." Based on this and other data, categorization module 224 may determine that user 150 is either on business trips or vacation during this 5% of the time. Further detail may be gleaned by analyzing the particular locations of user 150 during the daytime of that 5% of the time. Intelligent alerts may be sent when user 150 follows this pattern. For example, an intelligent alert may be sent to user 150 upon a determination that user 150 is on a business trip. The subject of the intelligent alert may include a prompt to leave a review on the hotel that user 150 stayed at (for example, after departing the hotel), a prompt to post a message that user 150 is in another city (for example, a social media message), or a prompt to visit a local point-of-interest (for example, a location near the hotel or the meetings attended by user 150). Alternatively, intelligent alerts may be sent when user 150 departs from a pattern. With regard to the 5% pattern explained above, an intelligent alert may be sent when user 150 is away from location "A" after 11:30 pm, but not more than 50 miles from location "A." The subject of the intelligent alert may include a prompt to leave a review of the user's location (if at a business location, for example), a reminder of the user's first event on tomorrow's calendar (e.g., an 8:30 AM meeting with a colleague or fellow student), or an alert to another person of the user's current location (e.g., a parent at location "A"), for example.

Once various locational behavior patterns have been identified for a particular user, categorization module 224 may compare the determined locational behavioral patterns to new drive data, location data, and/or time data to determine whether this new data is typical or atypical for the particular user. For example, rather than travel from location "A" to location "B" on a workday, user 150 may travel from location "A" to location "C." By referring to data from mapping database 105, categorization module 224 may determine that location "C" is an amusement park. Similarly, by referring to calendar data in POI/Events database 106, categorization module 224 may determine whether the "workday" is a national holiday, such as Labor Day. If user 150 traveled from location "A" to location "C" on most weekdays, it may be determined that user 150 is employed at the particular amusement park, rather than determining that the user frequents the amusement park on a daily basis for mere amusement. However, in the particular example above, user 150 rarely travels to location "C," so categorization module 224 may categorize this locational behavior as atypical of the previously-determined locational behavior pattern for user 150. Based on this deviation from an established pattern, decision module 232 may determine to send an intelligent alert to user 150. An exemplary intelligent alert may include a prompt to post a social media message on the user's location, such as "Do you want to post on [social media website] that you are at [Seven Flags Amusement Park]?" Such a prompt may include a "Yes" or "No" button. Based on user input (e.g., selection of either "Yes" or "No," the user's device may be transitioned to a social media application or website; alternatively, additional messages may be presented to user 150, such as various predetermined messages to post. For example, if user 150 selects "Yes," indicating user 150 would like to post a message on a social media website, for example, decision module 232 may output predetermined messages for the user to choose for posting, such as "A: Decided to take a break from work and head to Seven Flags!; B: Hitting the roller coasters with the family!; C: Spending my Labor Day at Seven Flags!," for example.

A user pattern may indicate that user 150 typically stays at location "A" (i.e., home) for the duration of Monday evenings. Input module 202 may receive data indicating that user 150 departed from this pattern and traveled to location "D" on a Monday evening and stayed between 6:15 pm and 7:25 pm. By referring to mapping database 105, data may be received that location "D" is a restaurant called Joe's Crab Cake Shack. Accordingly, the location of user 150 on this particular Monday evening may be categorized as atypical of the user's normal location (i.e., home). This and other categorizations may be relayed to other modules within alert server 101. This categorization may be used by decision module 232 to generate an intelligent alert, such as prompting the user to leave a review of the restaurant at location "D," and/or to post a message (such as on a social media website) that the user dined at Joe's Crab Cake Shack.

Figure 4B:
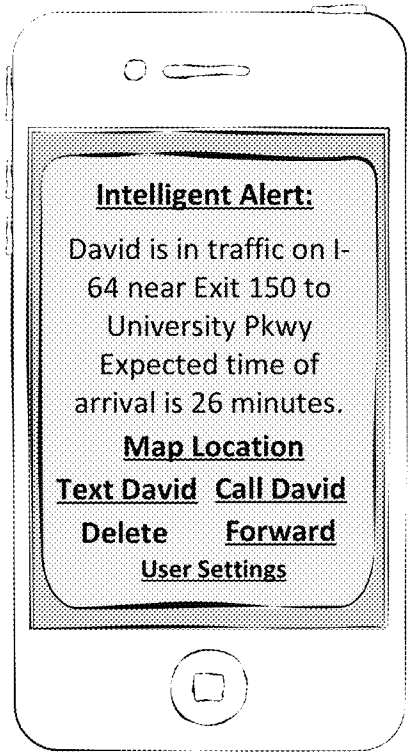
FIGS. 4A-4B depict exemplary intelligent alerts received at a user device, according to an exemplary embodiment of the invention.
Figure 4A:
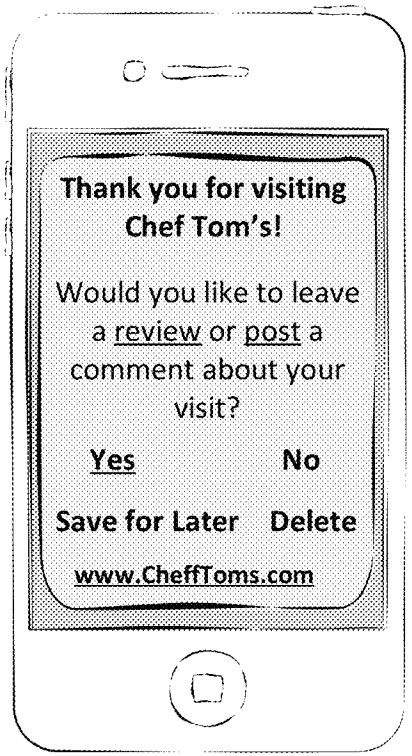

The locational behavioral pattern for user 150 may suggest that user 150 travels to several different locations on most Friday evenings (e.g., user 150 travels to at least one location other than location "A" on 70% of Friday evenings). Accordingly, "new" locational behavior need not be atypical of the user's typical locational behavior pattern for the present invention to be useful for the user. In other words, it may be a typical pattern for user 150 to travel somewhere different each week at a given time (e.g., Friday evenings). Nevertheless, the number of times user 150 has traveled to a particular location may be taken into account by alert server 101, and this number/frequency may be weighted when determining whether to send an intelligent alert to user 150. Categorization module 224 may weight locations from a user's location data. The locations that user 150 has traveled to a lower number of times may be given a greater weight than locations that user 150 has traveled to a large number of times. For example, if user 150 travels to a location for the first time (e.g., a restaurant that user 150 has never been to), this location may be given a higher weight than locations to which user 150 has traveled to before (e.g., a fast food restaurant that user 150 frequently visits) because such locations may be new to the user and/or the user's friends. Locations corresponding to a point of interest (which may be determined by referring to the POI/Events database 106) may also be given a greater weight than locations that do not correspond to a known point of interest. Accordingly, "new" locations that also correspond to a known point of interest may be given the greatest weight, and "old" locations that do not correspond to a point of interest may be given the lowest weight. One reason for this is that few people would want to receive an alert upon returning home stating, "You've just returned [home]! Would you like to post [on a social media site] that you've returned [home]?" Rather, many would welcome an intelligent alert stating, "This is your first time at [Chef Tom's]! Would you like to leave a review or post [on a social media site] a comment about your visit?" FIG. 4A shows an exemplary message that may be sent to user 150 as user 150 is leaving the restaurant or some time after user 150 has left (e.g., 2 minutes after user 150 has left, or after returning home). The underlined text in the exemplary message in FIG. 4A may indicate that the text is a hyperlink, and may link user 150 to another application, a website on the Internet, or lead user 150 to an additional option for choosing.

Alternatively, locations that user 150 has traveled to a higher number of times may be given greater weight than locations that user 150 has traveled to a small number of times. A low weight may cause decision module to forgo or delay sending an intelligent alert. Waiting until user 150 has frequented a particular location multiple times may allow user 150 to provide a more intelligent response to an alert, such as a prompt for the user to leave a review of a restaurant or a gym the user has visited several times, for example. In either case, by categorizing locational behavioral patterns, quantitatively and qualitatively assessing locations and corresponding times, and weighting such new locations/times, categorization module 224 contributes much intelligence to the type of alerts that may be distributed.

Driving behavior (alone or in combination with locational behavior) may also prompt an intelligent alert to one or more users. Further, in some embodiments, data may be gathered anonymously from a non-user for the benefit of a user of the present invention. For example, user 150 may be driving from location "B" to location "A" (e.g., work to home) one weekday evening, consistent with his normal locational behavior. However, the user's or another person's driving behavior on this particular occasion may prompt an intelligent alert to one or more users. For example, user 150 may be in 'stop-and-go' traffic because of an accident. Categorization module 224 may receive the location of user 150, and may refer to user database 108 for historical driving behavior of user 150 and determine that user 150 is not typically in this kind of traffic at this time and/or at this location (e.g., near Exit 150 to University Parkway.). Categorization module 224 may also refer to user database 108 for locational behavior or driving patterns of user 150 and determine that user 150 is likely headed home (location "A"). Based on the atypical driving behavior of user 150 who is stuck in traffic, categorization module 224 may refer to mapping database 105 and determine the distance to location "A" from user 150's current location, and may also determine an estimated time of arrival (ETA) based on current traffic conditions. User 150 may be prompted to text someone at home with a predetermined message based on the user's driving behavior on this particular evening (with calculated values inserted): "Stuck in traffic, will be home around [6:15 PM]!" Alternatively, as shown in FIG. 4B, another user (e.g., user 150's spouse) at location "A" (e.g., home) may automatically receive an alert explaining that user 150 is in traffic: "[David] is in traffic on [I-64] near [Exit 150 to University Pkwy]. Expected time of arrival is [26 minutes]." The information in brackets in a predetermined intelligent alert may be retrieved from one or more of the databases reflected FIG. 2, from user 150, from a device of user 150 (e.g., mobile device 120), from TCU device in vehicle 116, and/or calculated, for example. As should be appreciated, any number of intelligent alerts may be sent to one or more users based on the large amount of accessible data, patterns recognized over a period of time, and categorizations and weightings by categorization module 224, for example.

In another example, driving data from one or more vehicles may be used to generate intelligent alerts to one or more users 150. For example, input module 202 of alert server 101 may receive (anonymous) driving data from a vehicle indicating that the vehicle has made a hard stop at location "F." Categorization module 224 may refer to mapping database 105 and determine that location "F" is on an interstate and that the average speed at location "F" is 60 mph. Accordingly, categorization module 224 may categorize the hard stop by the vehicle at location "F" as atypical, based on recorded average speeds of vehicles at location "F." Input module 202 may receive data from user 150 (e.g., either from a device or a vehicle of user 150) traveling near location "F," the data indicating a current location, speed, and/or bearing of user 150, for example. Categorization module 224 may use the current location, speed, and/or bearing of user 150, and refer to mapping database 105, and may determine that user 150 is ¼ mile away from location "F," is headed toward location "F," and will arrive at location "F" in approximately 23 seconds. Decision module 232 may use this data to send an intelligent alert to user 150 (such as on vehicle display 140 within user 150's vehicle) that another vehicle has made a hard stop at location "F." Such alerts may be audible or visual or both. Intelligent alerts may be informative and cautionary, and an exemplary intelligent alert in this particular circumstance may audibly and/or visually indicate to user 150, "Caution: Traffic abruptly stopped in ¼ mile. ETA: 23 seconds. Slow down." Exemplary intelligent alerts may be textual or audible (such as a computer voice) and may vary in format, font, color, or sound, for example. Audible alerts may be sounded using a speaker, such as speakers on a vehicle, mobile device, or headphones, for example.

As can be seen in the above example, data may be gathered anonymously from a non-user for the benefit of a user of the present invention. The person in the vehicle that initially made a hard stop at location "F" may be a user or a non-user of the present invention. Nevertheless, information about the hard stop may benefit others, including users of the present invention, and such information may be anonymous with respect to the person in vehicle 116 that initially made the hard stop. In the above example, the intelligent alert was in the form of an alert to user 150 who was driving vehicle 116 approximately ¼ mile behind the vehicle that made the hard stop. By extension, the intelligent alert may be in the form of data to vehicle 116 itself. Particularly in the case of "self-driving" cars, rather than rely on camera-sight of a vehicle, data in the form of intelligent alerts can contribute to a safe and comfortable ride. Vehicles may be "self-driving" to different degrees. For example, similar to cruise control, a vehicle's computer may control the throttle and/or speed with some driver input (e.g., setting the cruising speed, and/or occasionally slowing down or speeding up). A greater degree of "self-driving" may employ cameras on the front of the vehicle to keep a safe distance from other vehicles, thereby utilizing camera-sight in addition to, or in lieu of, user input. Intelligent alerts may be used to enhance safety and comfort in vehicles using any degree of "self-driving." For example, an intelligent alert may be sent to vehicle 116 that is fully self-driving to enable it to slow down, well before any camera-sight would prompt the vehicle to slow down. The intelligent alert may be in the form of vehicle- and computer-readable data sent to a vehicle's TCU informing the TCU to cause the vehicle to slow down. The intelligent alert may also comprise a human-readable element, such as text displayed on a vehicle display 140 or audio played through the vehicle's speakers.

As is apparent from the present disclosure, users that are away from vehicle 116, such as a vehicle in/near a traffic hazard, may also receive intelligent alerts. For example, vehicle 116 may be involved in an accident. The TCU device on vehicle 116 may determine that vehicle 116 was involved in an accident and relay this data to input module 202. Categorization module 224 may categorize the data as a hazard, emergency, or accident, for example. Categorization module 224 may also weigh this data heavily (e.g., weigh such data a "10" on a scale of 1-10). Decision module 232 may receive this categorization and weighting from categorization module 224, and then retrieve contact information for users with an interest in such information. For example, user settings stored within user database 108 may indicate which users should receive intelligent alerts in the case of emergencies involving other users or vehicles, along with contact information for such users. Decision module 232 may retrieve this data and send intelligent alerts to such users with data on the emergency. An exemplary intelligent alert may state, "David's vehicle was involved in an accident on I-64 near Exit 150 to University Pkwy. Emergency personnel have been contacted. Would you like to call David?"

In other exemplary embodiments, intelligent alerts may be from many-to-one in that data from many vehicles/devices/ users may be used to send an intelligent alert to one (or a few) individuals or entities. By way of example, vehicle 116 may be traveling down a road and encounter a large pot hole at location "P." The vehicle's TCU device may record a force or large bump as a result of the vehicle's wheels hitting the pot hole, or as a result of the vehicle suspension system's response to the pot hole at location "P." As a result of this abnormal bump, the vehicle's TCU device may output to input module 202 data indicative of the pot hole (e.g., the force sensed at the wheel(s) because of the pot hole), the location of the incident (e.g., location "P"), and the time of the incident (e.g., 2/6/2014 6:36:22 PM). Based on this data, alert server 101 may output a message to vehicle 116 (e.g., an audio or text message to vehicle display 140) asking the driver for information on the bump. For example, after hitting an abnormal bump, a message may be sent that states, "Large force experienced at wheels at [6:36:22 PM]. Did you just encounter a pot hole?" The driver may then provide input by selecting, or audibly stating, either "Yes" or "No." If, "No," the driver may be prompted to provide information on the reason for the abnormal bump, or the abnormal bump may be ignored. Alternatively, alert server 101 may attempt to automatically determine whether the large force encountered by the wheels is atypical of that particular location (location "P"). Input module 202 may automatically retrieve data from the vehicle's TCU device at regular intervals and record such data in user database 108 or in storage module 234. Categorization module 224 may compare such data to historical data for that particular user at that particular location (location "P"), or may compare such data to other users/vehicles at that particular location (location "P"). As a result of such comparison, categorization module 224 may determine that the large force encountered by the vehicle's wheels at location "P" is atypical (e.g., due to a pot hole or debris on road) or typical (e.g., a speed bump or mildly uneven surface in road) of forces/data gathered for user(s) with respect to location "P." The size of the anomaly, or the degree to which the force is atypical, may be taken into account by categorization module 224 in the form of a weighting given to the atypical incident (e.g., on a scale of 1-10). Categorization module 224 may relay all the data it has retrieved and/or generated to decision module 232. Based on such data, decision module 232 may determine/decide to generate an intelligent alert, which data to submit with the intelligent alert, the format of the intelligent alert, where to send the intelligent alert, and when to send the intelligent alert. The intelligent alert may be in the form of an audible or visual prompt to a user (e.g., driver of vehicle 116) asking the user whether they would like to report the pot hole/atypical incident to government/business officials. Alternatively, decision module 232 may automatically send the intelligent alert to the relevant government/business officials (such as in the form of an email, a filled-out web form, or a text message, for example). POI/Events Database 106 may contain the relevant information (e.g., forms, contact information) for reporting incidents such as pot holes in the road. In this manner, rather than rely on the driver to report the pot hole to the relevant officials, alert server 101 may prompt the user to send in a report, or alert server 101 may automatically send the report for the user. All of this may be done anonymously such that no data about the driver/user (e.g., name, type of vehicle, speed) need be reported. Moreover, it is likely that many other vehicles are hitting the same pot hole. Alert server 101 may submit similar reports to the relevant officials for each vehicle that has a properly configured TCU device. Based on the type and number of reports received, the relevant officials may be more likely to quickly repair the road because it may be readily apparent where the pot hole is located (based on the location data gathered by the TCU device), the degree of the problem (e.g., higher sensed forces at a vehicle's wheels likely indicates a larger pot hole, and hence a greater safety hazard), and/or the number of people that the problem is affecting, for example. Additionally, alert server 101 may delay sending an intelligent alert to either the user/driver or automatically to relevant officials until a threshold number of similar incidents are recorded by alert server 101. As mentioned above, atypical events or behavior (along with typical events and behavior) may be recorded in user database 108 and/or storage module 234. Once a threshold number of atypical events are recorded (e.g., five), then alert server 101 may send an alert to the user(s)/driver(s) and/or officials. An exemplary intelligent alert to one or more users/drivers may state: "[Pot hole] experienced on [I-95] at [6:36:22 PM]. Would you like to report the [pot hole] to city officials?" The information in brackets may be determined based on TCU device data, user data, historical data, location data, or time data, for example; and the underlined information may lead the user to an internet address or a different application on the user's device (e.g., mobile device 120 or vehicle display 140). A prompt to report the pot hole to business officials may occur if the location is a private road or a parking lot of a business, for example. An exemplary intelligent alert to relevant city officials may state: "[Pot hole] experienced on [I-95] by [five] different vehicles over the past [two minutes twenty-seven seconds]. Location: [Southbound, I-95, Latitude 38.751941, Longitude: −77.185822]." Of course, the information in the intelligent alert need not be in brackets or be underlined; but underlining may indicate to a user that the text comprises a link, and brackets in the exemplary alerts may indicate information retrieved or calculated from the TCU device or from a database. Moreover, intelligent alerts may include text, audio, links, graphics, pictures, video, animation, a slide show, a single image, and/or a collection of images, for example. Preferably, the intelligent alerts may include a spoken message so as to limit or avoid interruptions to the driver. Moreover, the intelligent alert may comprise instructions to reduce the volume, mute, or pause other audio sources in the vehicle (or on the mobile device), such as the radio, an internal hard drive, a video, or a CD player, for example.

Other users may be informed of abnormalities in the road, including pot holes. For example, if one vehicle encountered a large pot hole at location "P," other vehicles implementing the present invention may be warned of such a pot hole or other abnormality. An exemplary intelligent alert to one user may state, "Large [pot hole] experienced in [left lane] of [I-95] [southbound] by vehicles [2.0 miles] ahead of you. Recommendation: change lanes." Such alerts may be sent based on the user's location, such as when the user is two miles away from the abnormality/road hazard and/or the user's current driving lane.

The above exemplary embodiment pertained to a pot hole, but it should be appreciated that, in the context of safety and driving, any type of safety hazard may be the subject of an intelligent alert. For example, debris on the road, road kill, improperly placed construction equipment such as steel plates, construction vehicles, police vehicles, vehicles stopped on shoulder of road, accidents, broken traffic lights, or anything that may be considered atypical by a threshold amount or which may cause a driver to deviate by a threshold amount from a normal/average speed or direction, or which may cause a user to abnormally stop a vehicle, may be subject of an intelligent alert.

As explained above, data may be analyzed by the categorization module 224 to categorize and/or weigh data. Various driving data may be categorized, such as a hard or soft stop/turn. Either the GPS data or accelerometer data gathered by the TCU device may be used to determine whether the vehicle stopped or turned. However, classifying a stop, for example, as either a "hard" stop or a "soft" stop may be done by comparing the accelerometer data (or rate of change of location data) to a threshold value. For example, a stop where the vehicle's velocity decreases by more than 20 ft/sec, on average, may be classified as a "hard stop" or a "sudden stop." If the driver slows to a stop by a rate slower than 20 ft/sec, then the stop may be categorized as a "soft stop" or not categorized at all. Similarly, turns may be categorized as either "hard turns" or "soft turns" or not classified at all. A gyroscope may be most effective in classifying turns, but a combination of data may be used. The rate of change of a vehicle's heading may be used to categorize whether turns are "hard" or "soft." Additionally, gyroscope data may be combined with velocity data or accelerometer data in categorizing various events. A rapid change in a vehicle's heading may not be considered a "hard turn" if the vehicle's velocity is very low. However, as the vehicle's velocity increases, a smaller rate of change in vehicle heading may still be considered a "hard turn." Accordingly, a plurality of values may be used to categorize turns as either "hard" or "soft." Alternatively, accelerometer data alone may be sufficient to categorize particular driving data as either "hard" or "soft." For example, centrifugal forces or other g-forces measured by the accelerometer may be compared to a predetermined threshold value. A turn that produces a centrifugal force in excess of 0.5 g, for example, may be considered a "hard" turn, where "g" is a measure of g-force.

Moreover, yet other driving data may be categorized, such as "late driving." "Late driving" may be categorized by comparing the time of the drive, as recorded by the TCU device, for example, to a predetermined time, such as 12:00 AM to 4:00 AM. Drives that occur within this exemplary time period may be categorized as "late driving."

Each of these categorizations may be useful for sending intelligent alerts. Intelligent alerts may be sent based on how various driving data is categorized and/or weighed. For example, once categorization module 224 categorizes certain driving data as "late driving," decision module may send an intelligent alert to user 150, which may be an owner of vehicle 116, or may be a parent of the driver of vehicle 116, for example.

The categorization module 224 may also take into account data from multiple users or vehicles. For example, a group of cars gathered at a grocery store parking lot would be normal, unless the grocery store closed hours ago. Categorization module 224 may determine whether the grocery store is closed by referring to POI/Events database (which may record business hours for various business or points of interest) or a website for the business at the location of interest (in this example, a grocery store). A parent may wish to receive intelligent alerts when their teenage children are out with a group of other people late at night in a deserted or unpopulated area (such as a parking lot of a business that closed hours ago or an empty field, for example). A user may control the type of alerts he/she receives by adjusting user settings, which may be stored in user database 108. Decision module 232 may refer to user database 108 when determining whether to send an intelligent alert. A parent may set their settings to receive intelligent alerts when their vehicle is away from home (e.g., location "A") past midnight, and is not traveling, but is stopped in a deserted or currently unpopulated area. An exemplary intelligent alert may state to such a user, "Your vehicle with license plate number [ABC-1234] is at [Safeway Grocery Store]. [Safeway Grocery Store] closed at [10:00 PM]." In this additional manner, users remote from their vehicle (or other vehicles) may receive intelligent alerts with respect to their vehicle (or other vehicles).

Categorization module 224 may detect patterns of typical driving or locational behavior when locations for a user/vehicle are consistent over particular times of a given day, week, month, or year. Several examples are given above, but simple exemplary patterns include a user consistently being at home, work, and/or school at particular periods of time, or taking consistent routes to/from these locations. Or the user may travel to particular places, such as business establishments or homes, at consistent times, including a friend or relative's home, the gym, music lessons, ball practice, a grocery store, restaurant, café, or salon, for example. Categorization module 224 may also detect patterns of typical driving or locational behavior based on routes traveled by the user/vehicle. For example, even if a user does not travel to particular locations at consistent times of the day/week/month, the user's route traveled to those locations may be very similar if not exact. A user may wish to go the gym, for example, twice a week, but in actuality only makes it to the gym an average of once every two weeks. Nonetheless, the route traveled by such user may be the same each time the user goes to a desired location—same starting location (e.g., home), same roads traveled, and same ending location (e.g., gym), for example. In such manner, even if locations and times (of day/week/month) do not match up over a particular period to yield a pattern, a pattern may nevertheless be detected by categorization module 224 if locations match up over a particular period (such as route traveled between two locations).

Once driving and/or locational behavior patterns (i.e., typical data) are detected, categorization module 224 may detect atypical behavior or events by comparing "new" user data to the previously-detected patterns or other historical data. For example, a driving pattern may suggest that the user does not typically stop at restaurant "R" on the way home from work. If the user/vehicle departs from the driving pattern and stops at restaurant "R," an "anomaly" or atypical event may be detected and categorized as such by categorization module 224. Similarly, a locational pattern may suggest that a user is typically at home at 11:00 PM on Sundays. If the user/vehicle "departs" from this locational pattern by being at another location at 11:00 PM on a given Sunday, an anomaly or atypical event may be detected and categorized as such by categorization module 224. Categorization module 224 may analyze more data than just user historical data before categorizing certain data as an atypical event. For example, categorization module 224 may take into account the particular location of the user/vehicle at the particular time (e.g., 11:00 PM on Sunday) and compare such location to mapping data from mapping database 105 and/or other databases (such as POI/Events database 106). If the mapping data indicates that the user's location is a hotel or an interstate hundreds of miles from the user's home, then the "event" may not be categorized as an atypical event, per se. However, if the mapping data indicates that the user's location is a local park, categorization module 224 may categorize such an event as atypical. Other data may support such a categorization, or may cause categorization module 224 to give a greater weight to the categorization. For example, if the local park referred to above was previously mentioned in news alerts pertaining to illegal drug usage (which news alerts may be recorded in POI/Events database 106), then greater weight may be given to the atypical categorization by categorization module 224.

Additionally, before any patterns are detected, "new" user data may simply be compared to historical data to detect whether the "new" user data is actually representative of a new event for the user, such as a new location for the user. For example, there may be no pattern (or detected pattern) for a user's location on Saturday evenings. A user's location on a given Saturday may be categorized as atypical or "new" if the location cannot be found in the user's historical location data. Similar to above, other data may support such a categorization, or may cause categorization module 224 to give a greater weight to the categorization. For example, if the "new" location is a business establishment that the user has never been to, then categorization module 224 may give greater weight to the categorization. Particular types of locations may be given greater weight than other locations, and the relative "interest" or popularity of a given location may be recorded in POI/Events database 106. For example, if a user visits a Department of Motor Vehicles for the first time, relatively little weight may be given to this "new" location. Alternatively, if the user attends for the first time a stadium, relatively greater weight may be given to this "new" location. Or if the user travels for the first time into a geographic region (such as a State), relatively greater weight may be given to this "new" location since it is "new" to the user, and may also be "new" to the user's friends or family.

Figure 5:
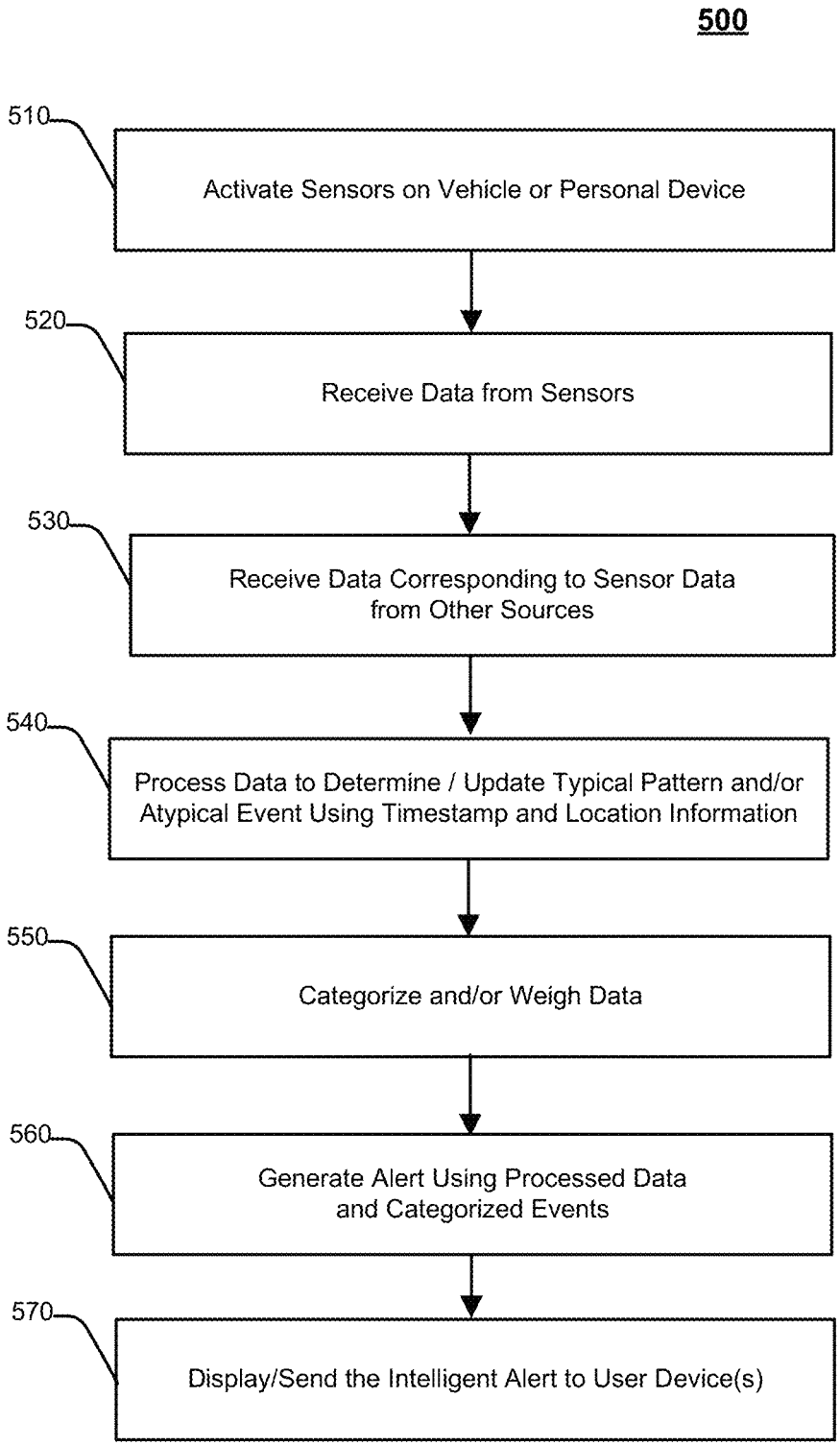
FIG. 5 depicts an illustrative flowchart of a method for generating intelligent alerts, according to an exemplary embodiment.

Referring to FIG. 5, an illustrative flowchart of a method for generating intelligent alerts is shown. This exemplary method 500 is provided by way of example, as there are a variety of ways to carry out methods according to the present disclosure. The method 500 shown in FIG. 5 can be executed or otherwise performed by one or a combination of various systems and modules. The method 500 described below may be carried out by system 100 shown in FIG. 1 and alert server 101 shown in FIG. 2, by way of example, and various elements of the system 100 and alert server 101 are referenced in explaining the exemplary method of FIG. 5. Each block shown in FIG. 5 represents one or more processes, decisions, methods or subroutines carried out in exemplary method 500, and these processes, decisions, methods or subroutines are not necessarily carried out in the specific order outlined in FIG. 5, nor are each of them required. Referring to FIG. 5, exemplary method 500 may begin at block 510.

At 510, sensors 117 may be activated on a vehicle (e.g., TCU device) or on a computing device, such as mobile device 120. When the sensors are activated they are ready to gather data. Exemplary sensors include a TCU device, accelerometer, GPS chip, gyroscope, etc., as explained above.

At 520, input module 202 of alert server 101 may receive or retrieve data from the sensors 117, directly or via network 102. The data from sensors 117 may be relayed directly to other modules in alert server 101.

At 530, input module 202 may receive or retrieve data from other sources, via network 102, which data may correspond to the sensor data that is being gathered or was previously gathered. Other sources may include mapping database 105, POI/Events database 106, environmental database 107, user database 108, user 150, mobile device 120, application server 103, vehicle(s) 116, non-users, or storage module 234, for example. This data may pertain to the driving data, such as the past/current/anticipated location of the vehicle or the user. For example, data from mapping database 105 may comprise maps of the past/current/anticipated location of the vehicle/user/mobile device, geographic data, campus data, building data, or traffic data, for example. The data from POI/Events database 106 may comprise point-of-interest data, calendar data, events data, website data, hours of operation data, social media data, application data, news alerts, or accident data, for example. The data from environmental database 107 may include information on the weather at the past/current/anticipated location of the vehicle/user/mobile device. Data from user database 108 may include user data, user settings, user relationships, user accounts, user login information, known user locations/patterns, historical data indexed by user, and contact information for users. Similar to above, data from other sources may be communicated directly from input module 202 to other modules of alert server 101.

At 540, categorization module 224 may quantitatively and qualitatively process the data by detecting typical driving or locational behavior patterns, comparing new data to such patterns or other historical data, identifying atypical behavior, identify a number or frequency of events, and/or correlating data from the sensors 117 with data from the other sources, for example. The data may be correlated by using the timestamp and location information within the data. In other words, data having the same or a similar timestamp and location-stamp may be correlated or linked together and then compared to other data.

At 550, categorization module 224 may categorize data or "events" as typical or atypical. Categorization module 224 may also weigh data based on the degree to which the data is reflective of new experiences (e.g., location is novel to user), established experiences (e.g., user has "experienced" a particular location several times, and thus likely has valuable information about that location), or importance of the event (e.g., safety of user or popularity of point-of-interest).

At 560, decision module 232 may determine whether to generate an intelligent alert, when to send the intelligent alert, the format of the intelligent alert, how to send the intelligent alert, and/or to whom the intelligent alert should be sent. Decision module 232 may do this using the categorized and/or weighed data from categorization module, and/or may use data from other sources, such as the data sources in FIG. 2. For example, decision module 232 may determine/decide to generate an intelligent alert based on an atypical event categorized by the categorization module 224, and/or based on a weight given to a particular event by the categorization module 224. Decision module 232 may determine to send an intelligent alert immediately or after a period of time, such as waiting until the user leaves or arrives at a particular location or region, for example. Decision module 232 may determine to send an intelligent alert as a text message, audible alert, visual alert, SMS message, email, a computer-generated voice message, video message, picture message, or more generally as a data message, for example. Decision module 232 may determine to send an intelligent alert to one or more user devices, such as mobile device 120, vehicle display 140, or network client 130, for example. Decision module 232 may determine to send an intelligent alert to multiple users, including users who are not at the location of the user device/vehicle that prompted the intelligent alert. Decision module 232 may refer to user settings and/or other data sources, such as user database 108 or storage module 234, to aid in performing its functions. For example, decision module 232 may refer to user database 108 to gather relevant contact information for users to whom an intelligent alert is to be sent. Further, various predetermined intelligent alerts may be stored in storage module 234, and information may be added to these predetermined intelligent alerts to complete the intelligent alert, as explained above with reference to information in brackets. For example, location data and/or identification data (e.g., names) may be added to predetermined intelligent alerts to complete the intelligent alert before sending. The intelligent alert may include a request for information from the user or may link the user to another source, such as a website or another application on the user's device.

At 570, the intelligent alert may be output by an output module to a user device, such as mobile device 120, vehicle display 140, or network client 130, for example. Depending on the type of intelligent alert, the user(s) may then input information in response to the intelligent alert and/or the user may link to a website or another application on the user's device. The user's input may be input audibly or tactilely, for example.

In summary, embodiments may provide a system and method for sending intelligent alerts to one or more users to allow the user to share information, or to aid the user with information provided in the intelligent alert.

In the preceding specification, various embodiments have been described with reference to the accompanying drawings. It will, however, be readily evident that various modifications and changes may be made thereto, and additional embodiments may be implemented, without departing from the broader scope of the disclosure as set forth in the claims that follow. The specification and drawings are accordingly to be regarded in an illustrative rather than restrictive sense.

What is claimed is:

1. A method comprising:

receiving, at an input module, sensor data over a period from one or more sensors onboard a vehicle, the sensor data comprising locational data and/or driving data of a user;

processing, at a categorization module, the sensor data received over the period to detect a behavioral pattern reflective of typical behavior of the user during the period, the behavioral pattern comprising a locational pattern or a driving pattern of the user;

receiving, at the input module, additional sensor data after the period from the one or more sensors onboard the vehicle, the additional sensor data comprising additional locational data and/or additional driving data;

comparing, at the categorization module, the additional sensor data to the behavioral pattern;

generating, at a decision module, an alert based on the comparing; and sending, by the decision module, the alert to a user device.

2. The method of claim 1, further comprising detecting an anomaly between the additional sensor data and the behavioral pattern based on the comparing, and wherein the alert is sent based on detecting the anomaly.

3. The method of claim 1, wherein the one or more sensors comprise a location sensor, an accelerometer, or a gyroscope.

4. The method of claim 1, further comprising receiving mapping data from a mapping database to aid in generating the alert.

5. The method of claim 1, wherein the alert is a text message or an audible alert.

6. The method of claim 1, further comprising categorizing, at the categorization module, events in the additional sensor data by comparing the additional sensor data to historical data for the user or to threshold values.

7. The method of claim 6, wherein the events categorized at the categorization module include at least one of: (i) traveling to a location that is new to the user, (ii) a hard stop, or (iii) an abnormal force encountered by the vehicle.

8. The method of claim 1, wherein the user device is a smartphone, a tablet computer, or a vehicle display.

9. The method of claim 1, wherein the alert comprises a message asking the user whether the user would like to post a message on a social network regarding the additional locational data or provide a review relating to the additional locational data.

10. The method of claim 1, wherein the user device to which the alert is sent was not at a location of the vehicle when the additional sensor data was received at the input module.

11. A system for generating alerts, the system comprising:

an input module configured to receive:

sensor data over a period from one or more sensors onboard a vehicle, the sensor data comprising locational data and/or driving data of a user;

additional sensor data after the period from the one or more sensors onboard the vehicle, the additional sensor data comprising additional locational data and/or additional driving data;

a categorization module configured to:

process the sensor data received over the period to detect a behavioral pattern reflective of typical behavior of the user during the period, the behavioral pattern comprising a locational pattern or a driving pattern of the user;

compare the additional sensor data to the behavioral pattern; and a decision module configured to:

generate an alert based on the comparing; and send the alert to a user device.

12. The system of claim 11, wherein the categorization module is further configured to detect an anomaly between the additional sensor data and the behavioral pattern based on the comparing, and wherein the alert is sent based on detecting the anomaly.

13. The system of claim 11, wherein the one or more sensors comprise a location sensor, an accelerometer, or a gyroscope.

14. The system of claim 11, wherein the input module is further configured to receive mapping data from a mapping database to aid in generating the alert.

15. The system of claim 11, wherein the alert is a text message or an audible alert.

16. The system of claim 15, wherein the categorization module is further configured to categorize events in the additional sensor data by comparing the additional sensor data to historical data for the user or to threshold values.

17. The system of claim 16, wherein the events categorized at the categorization module include at least one of: (i) traveling to a location that is new to the user, (ii) a hard stop, or (iii) an abnormal force encountered by the vehicle.

18. The system of claim 11, wherein the user device is a smartphone, a tablet computer, or a vehicle display.

19. The system of claim 11, wherein the alert comprises a message asking the user whether the user would like to post a message on a social network regarding the additional locational data or provide a review relating to the additional locational data.

20. The system of claim 11, wherein the user device to which the alert is sent was not at a location of the vehicle when the additional sensor data was received at the input module.

* * * * *